United States Patent [19]

Kawakami et al.

[11] 3,932,121

[45] Jan. 13, 1976

[54] PROCESS FOR THE DYEING OF MODIFIED POLYESTER FIBERS

[75] Inventors: Kazuo Kawakami; Hiroshi Imagome; Sumio Ishizaki; Genpei Sugiyama, all of Tokyo, Japan

[73] Assignee: Hodogaya Kagaku Kogyo Kabushiki Kaisha, Japan

[22] Filed: Oct. 5, 1973

[21] Appl. No.: 403,977

[30] Foreign Application Priority Data

Oct. 12, 1972 Japan ..... 47-101556

[52] U.S. Cl. ..... 8/21 C; 8/168; 8/169; 8/92

[51] Int. Cl.[2] ..... D06P 3/82

[58] Field of Search ..... 8/21 C, 168, 169, 92

[56] References Cited

UNITED STATES PATENTS

| | | | |
|---|---|---|---|
| 3,545,910 | 12/1970 | Ong | 8/21 C |
| 3,681,005 | 8/1972 | von der Eltz et al. | 8/21 C X |
| 3,723,055 | 3/1973 | Hooper et al. | 8/21 C |

*Primary Examiner*—William F. Hamrock

*Attorney, Agent, or Firm*—Wenderoth, Lind & Ponack

[57] ABSTRACT

A novel process for the dyeing of modified polyester fibers containing sulfonate group, as well as mixed fibers and union fabrics thereof with other fibrous materials with cationic dyestuff is provided. The dyeing is carried out in the presence of one or more of aliphatic dicarboxylic acid diesters containing 8 to 14 carbon atoms. The resulting dyeings possess an outstanding fastness properties especially fastness to light.

4 Claims, No Drawings

PROCESS FOR THE DYEING OF MODIFIED POLYESTER FIBERS

This invention relates to an improved process for the dyeing of modified polyester fibers containing sulfonate group, as well as their mixed fibers and union fabrics with other fibrous materials.

More particularly, the present invention is directed to a process for dyeing of the modified polyester fibers containing sulfonate group of a type capable of dyeing with a cationic dyestuff, whereby the dyeing properties of the fibers with cationic dyestuff are considerably improved by the aid of a specific aliphatic dicarboxylic acid diester as dye assistant.

It is known that fabrics made of the hitherto known polyester fibers generally possess excellent physical properties such as tough and resilient feelings, anti-creasing, pleats-durability, dimensional stability and wash-and-wear properties. Unfortunately, the polyester fibers are inferior to polyamide fibers with respect to their dyeability with acid dyestuff, on the one hand, and to acrylic fibers with respect to their dyeability with cationic dyestuff, on the other.

Many efforts and studies have been made for establishment of imparting an improved dyeability to the known polyester fibers with basic dyestuff, and at present, modified polyester fibers meet with such a requirement are available in the market.

Although these modified types of polyester fibers featuring dyeability with basic dyestuff possess a good absorbing capacity of cationic dyestuff, it was found that the dyeability of the modified polyester fibers with cationic dyestuff are not as excellent as those of acrylic fibers with cationic dyestuff.

In addition, cationic dyestuff does not usually yield a satisfactory dyeing on the modified polyester fibers, unless otherwise the dyeing is conducted at considerably high temperatures such as 120° to 130°C.

In carrying out the dyeing at such high temperatures, there are, however, the disadvantages of requiring a high temperature dyeing machine, on the one hand, and limiting the types of cationic dyestuff adaptable for this process, on the other. This is because some of the known cationic dyestuffs are apt to thermal decomposition at high temperatures such as 120° to 130°C.

Under the circumstances, a provision of dyeing method adaptable for carrying out at a relatively low temperature has been wanted in the art of this field.

For the purpose of enhancing dye-absorbability of the dyeing materials, a dyeing procedure that can be effected at a relatively low temperature was proposed, which is characterized by the presence of a carrier.

The carrier recommended in that process was a non-ionic carrier such as Latyl Carrier A, a commercial name given to a product manufactured by E. I. du Pont de Nemours & Company of U.S.A. [See "American Dyestuff Reporter", 50, No. 12, pp 445–450 (1961).]

It was, however, found that with such a known carrier, dyeings are obtained which possess a poor fastness to light that makes them worthless from a commercial viewpoint.

Now, as a result of our extensive researches on improvement of cationic dye-absorbability of the modified polyester fibers which contain sulfonate group, as well as mixed fibers and union fabrics thereof with other known fibrous materials, a novel process for dyeing of said fibrous materials has been established, which is capable of producing the dyeings having improved fastness to light, unlike the dyeings of poor fastness to light such as aforementioned, which have been obtained by the known process in which the carrier is employed.

According to the process of this invention, the dyeing of the abovementioned modified polyester fibers is carried out in the presence of one or more of aliphatic dicarboxylic acid diesters containing 8 to 14 carbon atoms in their molecular structure as dye assistant, which may also be called "Carrier". By adding the specified diester or diesters to the baths for dip-dyeing and pad-dyeing or to a printing paste, a considerable enhancement of absorbability of cationic dyestuff on the modified polyester fibers is attained.

In this regard, it has further been found that an inferior dye absorbability is attained when an aliphatic dicarboxylic acid diester or diesters containing carbon atoms less than 8 or more than 14 is/are employed as carrier instead of those specified in the process of this invention.

The specific aliphatic dicarboxylic acid diester employed in carrying out the process of this invention embraces saturated and unsaturated aliphatic dicarboxylic acid diesters so far as they contain 8 to 14 carbon atoms as aforementioned.

Typical examples of the saturated dicarboxylic acid diesters include the diesters of oxalic, malonic, succinic, glutaric, adipic, piperic, suberic, acelaic, sebacic and the like acids; and the typical examples of unsaturated aliphatic dicarboxylic acid diesters include the diesters of maleic, fumaric, itaconic, citraconic, mesaconic, glutaconic, and the like acids. Other types of the corresponding diester which may be employed are those of alkyl-substituted aliphatic saturated and unsaturated dicarboxylic acids such as $\beta$-methyl adipic, $\alpha$-methylglutaric and methyl malonic acids.

The alkyl radicals which form said diesters of dicarboxylic acids include linear alkyl groups such as methyl, ethyl, n-propyl and n-butyl, and the branched alkyl radicals such as iso-propyl, sec-butyl and tert-butyl. Allyl radical may further be added as unsaturated alkyl group. Same or different alcohol components may be used for imparting the alkyl radicals required for the formation of the aforementioned various diesters.

Amongst the aforementioned aliphatic dicarboxylic acid diesters that we can employ are the alkyl diesters such as di-n-butyl oxalate, diethyl ethylmalonate, di-n-propyl malonate, di-n-butyl malonate, diethyl methylmalonate, diethyl allylmalonate, dimethyl diethylmalonate, diethyl maleate, di-n-butyl maleate, diallyl maleate, diethyl fumarate, diethyl succinate, di-n-butyl succinate, diallyl succinate, diethyl glutarate, diethyl itaconate, di-n-butyl itaconate, dimethyl adipate, diethyl adipate, di-iso-propyl adipate, di-n-butyl adipate, dimethyl sebacate, diethyl sebacate, tert-butyl ethylmalonate and the like. As is apparent, the above diesters are mere exemplification for the sake of well understanding of the invention, and accordingly, the invention, needless to say, should not be restricted to use only these compounds.

The quantity of the aliphatic dicarboxylic acid diesters employed may vary to some extent being dependent partly on the intended depth of the shade of dyeing and partly on the method used for dyeing. As for dip dyeing, the diester may be used in an amount of from about 0.1 grams to about 50 grams and preferably from about 1 gram to about 20 grams per liter of the bath; as for pad-dyeing, the diester in an amount of from about 0.1 grams to about 100 grams and preferably from about 5 grams to about 50 grams per liter of the bath; and as for printing, the diester in an amount of from about 0.1 grams to about 100 grams and preferably from about 5 grams to about 50 grams per kilogram of the printing paste.

Since most of the diesters possess a relatively low solubility in water, the same is desirably added to dip and pad dyebaths and to printing paste in a form of an aqueous dispersion previously prepared by the aid of a nonionic surfactant as emulsifier.

As suitable nonionic surfactant that can be employed for this purpose, there may be mentioned polyoxyethylene alkylphenol ether, polyoxyethylene acyl ester, polyoxyethylene sorbitan aliphatic acid ester, polyoxyethylene alkyl ether and the like.

Amount of the nonionic surfactant used for formation of a homogeneous dispersion of the aforementioned diester in a contemplated dyebath for dipping or padding may vary in the range of from 1/10 to 2 times and preferably from 1/5 to 1/2 times by weight on the basis of the weight quantity of the diester employed.

It will be understood that the modified polyester fibers of the type dyeable with cationic dyestuff to be used in carrying out the dyeing process according to the present invention are those which contain sulfonate group as the dyeing site for the cationic dyestuff.

As concrete examples of the abovementioned modified polyester fibers, there may be mentioned various types of Dacron spun fibers such as Dacron Types 64, 65, 651, 89, 161, 167, 62, 92 and 69, all manufactured by E. I. du Pont de Nemours & Company of U.S.A.; Fortrel Types 402 and 404 manufactured by Cellanese Corp. of U.S.A.; Kodel Types 511 and 541 manufactured by Tennecy Eastman Chemical Products Inc. of U.S.A.; Trevira Type 440 manufactured by Hystron Fibers Inc. of U.S.A.; Tetoron Type A manufactured by Toray Company of Japan and so forth.

As the cationic or basic dyestuffs suitable for use in carrying out the process of the present invention, there may be mentioned various dyestuffs of methin and azomethin series which contain indolenium, pyrrazonium, imidazolium, triazolium, oxazolium, thiaziazolium, oxazolium, thiazolium, pyridinium, pyrymidium or pyrazinium ring; the dyestuffs of diphenylmethane, triphenylmethane, oxazine, thiazine and xanthene series; the dyestuffs of heterocyclic azo and anthraquinone series; and the so-called non-conjugated type arylazo dyestuffs which contain an external onium group.

The process of this invention, as is aforementioned, is applicable for pad dyeing and printing in addition to dip-dyeing.

According to the process of this invention, there are obtained the dyeings of heavy shades with outstanding fastnesses to light at a lowered dyeing temperature.

In a preferred practice of the dip-dyeing according to the present invention, a cationic dyestuff suitably chosen is first mixed thoroughly with an about half amount of the total volume of acetic acid required for keeping the pH of a dyebath about 4. The resulting paste is subsequently dissolved into an appropriate quantity of hot water together with the remaining acetic acid. If desired, there may further be added a suitable amount of sodium sulfate to the solution. Sodium sulfate serves not only to prevent lowering of mechanical strength of the fibers, but also to retard velocity of the dyestuff taken up by the fibers to result in an even dyeing.

Sodium sulfate as anhydrous state may advisably be added in an amount of from 1 gram to 5 grams per liter of the bath. To the bath thus obtained, there is added the specified aliphatic dicarboxylic acid diester or diesters of the present invention. In this occasion, the diester may preferably be added in combination of an amount of a nonionic surfactant, in order to obtain a homogeneous dispersion of the diester or diesters into the bath. Alternatively, the aliphatic dicarboxylic acid diester or diesters may be added to the bath in a form of an aqueous dispersion previously prepared by the aid of said nonionic surfactant.

The dyebath may preferably be kept at a pH of from 3 to 5 with acetic acid or any other organic acid conventionally employed in the dyeing process with cationic dyestuff, although the pH may be held to that lower than 3 or higher than 5, if desired.

When the dyebath at a desired liquor ratio is prepared, a definite amount of the fibrous material to be dyed is placed thereinto. At that time, the bath may be kept at a room temperature to 80°C.

The dyeing operation is carried out at 90°C. to 120°C. and preferably at 100°C to 110°C. for 60 to 90 minutes. It is recommendable to carry out the dyeing under ordinary pressure and at a temperature up to 100°C. If the dyeing is carried out under pressure and at a higher temperature, the dyeing operation can be completed in a shorter time than the case where the particular aliphatic dicarboxylic acid diester of the present invention is absent.

The dyed material thus obtained may further be worked up in a usual manner by washing with water and then with hot water and soaping. If necessary, the material may be subjected to a reductive scouring.

In practice of the dyeing by means of a pad-dyeing, the dyestuff is first mixed with a suitable quantity of an organic acid such as acetic or tartaric acid and the resulting mixture is then dissolved in a hot water. To the solution, there is added a suitable amount of a pasting material dissolved in a cold or warm water as thickening agent conventionally employed in the art of the pad-dyeing and printing. As the pasting materials, there may be mentioned starch and its derivatives, cellulose derivatives, locust bean paste, crystal gum and mixture thereof.

The aliphatic dicarboxylic acid diester(s) may be added, like in the dip-dyeing, as a mixture previously prepared with a nonionic surfactant to the pad liquor or may be added in a form of aqueous dispersion previously emulsified with the surfactant. Alternatively, the nonionic surfactant as in the case of dip-dyeing may be added afterwardly to the padliquor with through stirring. In case there occurs a considerable foaming, there may be added an anti-foaming agent. To the resulting padliquor, there is placed a dyeing material and the liquor is brought to evenly penetrate into the fibers. Excess liquor on the fibers is removed by squeezing on a mangle. The fibers after drying or without drying are subjected to steaming. The steaming is effected at a temperature of 95°C. to 135°C. for 20 seconds to 60 minutes to result in a complete fixation of the dyestuff onto the fibers.

After the steaming, any stuck dyestuff unfixed is removed either by washing the pad fibers with hot water and then with cold water, or by treating the pad fibers in accordance with a usual manner with an aqueous bath at 40°C. to 70°C. for 5 to 20 minutes, which contains a suitable surfactant selected from the group consisting of the nonionic, anionic and cationic surfactants and finally washed with water. If necessary, the dyed fibers may be worked up by subjecting them to a reductive washing.

Finally, in carrying out the printing method according to the present invention, a printing paste is first prepared in the procedure almost the same as that employed in the preparation of the abovementioned padliquor, with exception of the use of a smaller quantity of water. In case there is a difficulty is dissolution of the dyestuff into such a small quantity of water, it is desirable to add an amount of a dyestuff-dissolution aid to the liquor such as thiodiethylene glycol, for example. Consistency of the resulting printing paste may be adjusted by adding an additional amount of the pasting material to an extent suitable for carrying out a usual screen printing.

Addition of the specified aliphatic dicarboxylic acid diester(s) to the contemplated printing paste can be effected in a manner wholly same as those used in the preparations of the dyebaths for dip- and pad-dyeings.

In practice of the printing, the fabric woven with the modified fibers is printed as usual with the abovementioned printing paste, dried and steamed at a temperature of 95°C. to 135°C. for 20 seconds to 60 minutes. After then the printed fabric is washed with water or subjected to a soaping as usual. If necessary, the printed fabric may be worked up by further subjecting it to a reductive washing to scour any stuck dyestuff unfixed.

The process of this invention will be illustrated more in detail by the following working Examples, part being by weight and percentages of the used substances being based on parts by weight of the materials to be dyed.

The rate of absorption of the dyestuff by the material is calculated on the data of the estimation of absorbance of the comparative solutions which are prepared by equally diluting the respective samples with acetic acid and methanol, one of the samples having been taken from the original dyebath unused, and the other of the samples from the spent liquor of the dyeing operation.

Fastness to light of the dyed material is measured in accordance with the procedure of AATCC 16A–1964.

EXAMPLE 1

Dyeings including a control dyeing were prepared on each 10 grams of Dacron Type 62 of E. I. du Pont de Nemours, a modified polyester fibers dyeable with basic dyestuff, with 2% of the dyestuff represented by the formula

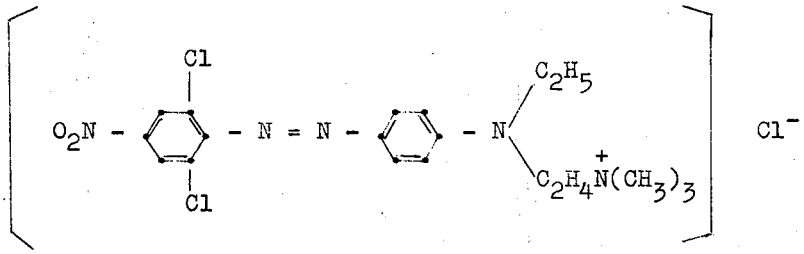

which was prepared in accordance with the method disclosed in U.S. Pat. No. 2,972,508.

The dyebaths of the following composition were used for the above dyeings, which, with exception of the bath used for dyeing of the control, contained 5 grams per liter of a mixture consisting of 80 parts of dimethyl sebacate of the formula $CH_3OOC(CH_2)_8COOCH_3$ containing 12 carbon atoms as carrier, and 20 parts of Nissan Nonion NS-230, the trade name given to a nonionic surfactant consisting of polyoxyethylene nonylphenol ether manufactured by Nippon Oils and Fats Company of Japan, as dispersant for the carrier.

| Composition | |
|---|---|
| Dyestuff as aforementioned | 2% |
| Anhydrous sodium sulfate | 4% |
| Mixture of dimethyl sebacate and Nissan Nonion NS-230 | 5grs./l |

pH of each of the dyebaths was adjusted to 4 with acetic acid.

The dyeing operations were conducted at the liquor ratio of 50:1 starting at 80°C. The temperature of the dyebaths were gradually raised to 100°C. over 20 minutes, and the dyeings were continued at that temperature for further 60 minutes.

In comparative observation of the resulting dyeings with regard to their rate of dye absorption, there were obtained 99.3% dye absorptions on the dyeing obtained by the aid of the aforementioned carrier and 32.7% dye absorption on the control dyeing. From the data, it is noted that the dye absorption of the former amounts to about three times greater than that of the latter.

Further observation on the fastness to light of these dyed materials exhibited the fastness of Grade 6 with the material obtained by the aid of the carrier, while the dyed material obtained without use of the carrier exhibited the fastness of Grade of 4 – 5. Here again, it is noted that the favourable effect of the carrier is obtained on the enhancement of the fastness to light of the resulting dyeing.

EXAMPLE 2

Dyeings including a control dyeing were prepared on each 10 grams of Dacron Type 62 under the dyeing conditions same as those employed in Example 1 with each 2% of the dyestuff of the formula

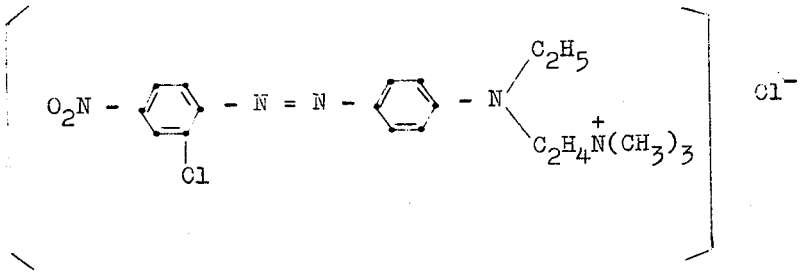

which had been prepared by the method disclosed in U.S. Pat. No. 2,972,508.

Apart from the above, a mixture was prepared with 80 parts of diethyl adipate of the formula $C_2H_5OOC(CH_2)_4COOC_2H_5$ containing 10 carbon atoms as carrier, and 20 parts of Noigen HC, the trade name given to polyoxyethylene oleylether manufactured by Dai-ichi Kogyo Seiyaku K. K. (The First Industrial Chemicals Manufacturing Company of Japan).

With exception of the bath used for the control, 3 grams of the above resulting carrier mixture were added per liter of the bath, and the total mixture was thoroughly stirred to obtain a homogeneous dispersion.

The dyeing operations were conducted for the respective dyebaths in the manner same as that employed in the preceding Example.

In inspection of the dyeings with respect to their dye absorption, a good rate of the dye absorption amounting to 99.1% was observed on the dyeing obtained by the aid of the carrier, in comparison with 60.6% dye absorption in the control dyeing.

Further, in estimation of the fastness to light of the dyed fibers, the dyeing obtained by the aid of the carrier exhibited the fastness of Grade 5, while the dyeing obtained without use of the carrier exhibited the fastness to light of Grade 3–4.

Still further, observation under microscope of the cross sections of the dyed fibers gave that the dyestuff employed thoroughly penetrated up to the central portion of the sectional area of the fibers which were dyed by the aid of the carrier, whereas the penetration of the dyestuff was limited only to the external area of the fibers of the control dyeing.

EXAMPLE 3

Dyeings were carried out in accordance with the dyeing procedure equal to that employed in Example 2 with exception of the use of dyeing temperature at 105°C. and the dyeing duration for 45 minutes instead of those employed in said Example 2.

On the resultant dyeings, the rate of dye absorption and the light fastness were comparatively observed. The data of the observations are tabulated below:

| Diethyl adipate as carrier | Rate of dye-absorption (%) | Fastness to light (Grade) |
|---|---|---|
| Without addition | 81.6 | 3 – 4 |
| With addition | 99.8 | 5 – 6 |

As can be seen from the above Table, there were considerable improvements in the rate of dye absorotion and the fastness to light of the dyeing obtained with the dyebath which contained the diethyl adipate carrier over those of the control dyeing.

EXAMPLE 4

A bath for pad-dyeing having the following composition was prepared by using diethyl fumarate of the formula $C_2H_5OOCCH{:}CHCOOC_2H_5$ as carrier, which contains 8 carbon atoms.

| | Parts |
|---|---|
| Dyestuff obtained by Example 1 of U.S. Patent 3,132,132 | 3 |
| 30% Acetic acid | 10 |
| 50% Tartaric acid | 3 |
| Hot water | 30 |
| 5% San-print AFP (Trade name given to a paste manufactured by Sansho Company of Japan) | 20 |
| Diethyl fumarate | 3 |
| Noigen HC (vide supra) | 1 |
| Water | 30 |
| Total | 100 |

Dacron Type 62 were placed in the bath. The fibers, when thoroughly impregnated with the liquor, were squeezed on a mangle to a 100% moisture content, which without drying was subjected to steaming at the temperature of 100°C. for 10 minutes, washed with hot water followed by washing with cold water and dried. There was obtained a dyed material having a heavy and even shade of excellent fastness without shrinkage and the original touch.

As for control, a dyeing was separately prepared on the fibers in the same manner as to the preceding paragraphs with a pad-dyebath having the similar composition to the above but contained no carrier.

The resulting dyeing had a lighter shade which was evidently distinguished from the shade of the above dyeing obtained by the aid of diethyl fumarate as carrier.

EXAMPLE 5

A fabric of Dacron Type 62 was printed with a printing paste of the following composition which contained di-n-butyl maleate of the formula $C_4H_9OOCCH{:}CHCOOC_4H_9$ containing 12 carbon atoms as carrier.

| | Parts |
|---|---|
| Aizen Cathilon Orange GLH, the trade name given to C. I. Basic Orange 21 (C. I. 48035) prepared by Hodogaya Chemical Company of Japan) | 3 |
| 50% Acetic Acid | 3 |
| 50% Tartaric acid | 3 |
| Cold (hot) water | 27 |
| 20% San-print AFP (vide supra) | 60 |
| Di-n-butyl maleate | 3 |
| Noigen HC (vide supra) | 1 |
| Total | 100 |

The fabric was printed as usual with the printing paste of above composition, dried, steamed at the temperature of 105°C. for 20 minutes, washed with hot water followed by washing with cold water and again dried. There was obtained a print on the fabric having a brilliant heavy orange shade of a marked dye fixation.

A control print was produced on the same fabric as the above with a printing paste similar to the above-mentioned composition with exception of elimination of di-n-butyl maleate.

In comparison of the printings, it was found that the former print obtained by the aid of the carrier possessed a marked improvement in the dye fixation and a brilliant heavy shade in contrast to those of the control print.

EXAMPLE 6

5 Grams of Dacron Type 62 were dyed with 3% of Aizen Cathilon Yellow 3GLH, the trade name given to C. I. Basic Yellow 11 (C. I. 48055) which was manufactured by Hodogaya Chemical Company of Japan.

The dyebath used was prepared by adding 5 grams per liter of di-n-butyl malonate of the formula $C_4H_9OOC\text{-}CH_2\text{-}COOC_4H_9$ containing 11 carbon atoms as carrier, and 1 gram per liter of Noigen HC to facilitate dispersion of the carrier. A homogeneous emulsion was obtained by thoroughly stirring the total mixture.

Dyeing was conducted under the conditions same as those employed in Example 1.

Comparison was effected with respect to the rate of dye absorption and the fastness to light of the former dyeing with the control dyeing which was obtained with a dyebath similar to that used in the preceding dyeing bath but not contained di-n-butyl malonate. The data obtained are tabulated below.

| Di-n-butyl malonate as carrier | Rate of dye-absorption (%) | Fastness to light (Grade) |
|---|---|---|
| Without addition | 83.0 | 4 – 5 |
| With addition | 99.5 | 5 – 6 |

EXAMPLE 7

Dyeings including a control dyeing were produced on Dacron Type 62 in accordance with the procedure given in Example 1 with 2% of a basic dye prepared in accordance with Example 1 of U.S. Pat. No. 3,679,656. With exception of the bath for the control dyeing, there were further added 4 grams per liter of the bath of a mixture consisting of 80 parts of diethyl ethylmalonate of the formula $C_2H_5OOC\text{-}CH(C_2H_5)\text{-}COOC_2H_5$ containing 9 carbon atoms as carrier and 20 parts of Nissan Nonion NS-230 (vide supra) as dispersant for the carrier.

In comparative observation of the rate of dye absorption and the fastness to light of the resultant dyeings, there were obtained the following data.

| Diethyl ethylmalonate as carrier | Rate of dye-absorption (%) | Fastness to light (Grade) |
|---|---|---|
| Without addition | 78.5 | 4 – 5 |
| With addition | 99.8 | 5 – 6 |

As can be seen from the above data, there is a marked enhancement over the control in the rate of dye absorption and the fastness to light of the dyeing obtained from the dyebath where diethyl ethylmalonate was added as carrier.

EXAMPLE 8

Dyeings including a control dyeing were produced on Dacron Type 62 with a dyeing mathod similar to that employed in the Example 1.

3% of the dyestuff was employed which was the same as that employed in Example 4. With exception of the dyebath for the control, there was added to the bath di-n-butyl adipate of the formula $[\text{—}CH_2CH_2COO(CH_2)_3CH_3]_2$ containing 14 carbon atoms, as carrier.

The dyeing operations were conducted under the conditions same as those employed in Example 1. The carrier in an amount equal to that employed in Example 1 was added to the bath in a manner same as that mentioned in Example 1.

In comparative observation of the resulting dyeings with respect to the rate of dye absorption and the fastness to light, data were obtained which were tabulated below.

| Di-n-butyl adipate as carrier | Rate of dye-absorption (%) | Fastness to light (Grade) |
|---|---|---|
| Without addition | 85.5 | 4 |
| With addition | 98.8 | 5 – 6 |

As can be seen from the above data, there is a marked enhancement over those of the control in the rate of dye absorption and the fastness to light of the dyeing obtained from the dyebath where di-n-butyl adipate was added as carrier.

EXAMPLE 9

Dyeings including a control dyeing were produced on each 5 grams of Dacron Type 62 with 3% of Aizen Cathilon Pure.Blue-5GH, the trade name given to C. I. Basic Blue 3 (C. I. 51005), manufactured by Hodogaya Chemical Company of Japan. With exception of the bath used for the control, carrier was added per liter of the bath 3 grams of a mixture prepared by warming 80 parts of a 1 : 2 mixture of di-n-butyl adipate of the formula $[\text{—}CH_2CH_2COO(CH_2)_3CH_3]_2$ containing 14 carbon atoms and di-n-butyl maleate of the formula $[\text{=}CHCOOC_4H_9]_2$ containing 12 carbon atoms, both of the carriers belonging to the aliphatic dicarboxylic acid diester specified in the instant invention, and 20 parts of Nissan Nonion NS-230 (vide supra) as the dispersant for the carriers. At the time the mixture of the carriers was introduced into the bath, there was additionally added 1% of Noigen HC as dispersant for the carriers. The dyeing operations were conducted under the conditions same as those employed in Example 1.

Comparative observation was conducted on the resultant dyeings with respect to their rate of dye absorption and the fastness to light. Data were obtained which were listed below.

| The 1 : 2 mixture of di-n-butyl adipate and di-n-butylmaleate as carrier | Rate of dye-absorption (%) | Fastness to light (Grade) |
|---|---|---|
| Without addition | 88.2 | 4 |
| With addition | 99.5 | 5 |

What is claimed is:

1. A process for dyeing modified polyester fibers containing sulphonate groups, either alone or in the form of mixed fibers or fabrics containing them, with a cationic dyestuff selected from the group consisting of methines, azomethines, diphenylmethanes, triphenylmethanes, oxazines, thiazines, xanthenes, heterocyclic azos, anthraquinone series dyestuffs and non-conjugated type arylazo dyestuffs having an external onium group, wherein the dyeing is performed in the presence of one or more aliphatic dicarboxylic acid dialkylesters or diallylesters containing from 8 to 14 carbon atoms.

2. A process according to claim 1 wherein the aliphatic dicarboxylic acid diester is di-n-butyl maleate of said acid.

3. A process according to claim 1 wherein the aliphatic dicarboxylic acid diester is diethyl diadipate of said acid.

4. A process according to calim 1 wherein the aliphatic dicarboxylic acid diester is di-n-butyl malonate of said acid.

* * * * *